US005249804A

United States Patent [19]

Sanchez

[11] Patent Number: 5,249,804

[45] Date of Patent: Oct. 5, 1993

[54] GOLF BALL DIMPLE PATTERN

[75] Inventor: Richard R. Sanchez, Peoria, Ariz.

[73] Assignee: Karsten Manufacturing Corporation, Phoenix, Ariz.

[21] Appl. No.: 944,081

[22] Filed: Sep. 11, 1992

[51] Int. Cl.[5] ..... A63B 37/14

[52] U.S. Cl. ..... 273/232

[58] Field of Search ..... 273/232, 235 R; 40/327

[56] References Cited

U.S. PATENT DOCUMENTS

| | | | |
|---|---|---|---|
| 4,560,168 | 12/1985 | Aoyama . | |
| 4,653,758 | 3/1987 | Solheim . | |
| 4,915,389 | 4/1990 | Ihara . | |
| 4,915,390 | 4/1990 | Gobush . | |
| 4,925,193 | 5/1990 | Melvin et al. | 273/232 |
| 4,960,283 | 10/1990 | Gobush | 273/232 |
| 5,009,427 | 4/1991 | Stiefel et al. | 273/232 |
| 5,016,887 | 5/1991 | Jonkouski | 273/232 |
| 5,062,644 | 11/1991 | Lee | 273/232 |
| 5,092,604 | 3/1992 | Oka | 273/232 |
| 5,123,652 | 6/1992 | Oka | 273/232 |
| 5,201,522 | 4/1993 | Pockllngton et al. | 273/232 |

FOREIGN PATENT DOCUMENTS 377354 8/1932 United Kingdom .

*Primary Examiner*—Mark S. Graham

*Attorney, Agent, or Firm*—Darrell F. Marquette; Herbert E. Haynes, Jr.

[57] ABSTRACT

A golf ball has dimples formed in its outer spherical surface and arranged in a geodesic pattern defined by a plurality of imaginary grid lines which divide the outer spherical surface into an icosahedron having twenty triangular regions. Each triangular region is defined by three of the grid lines which form a spherical equilateral triangle having three sides of equal length and three medians of equal length. The dimples are arranged so that each side of the triangle radially intersects at least seven dimples, and each median of the triangle radially intersects at least six dimples. The golf ball has a total of 362 dimples including 242 dimples with a diameter of 0.140 inch and 120 dimples with a diameter of 0.150 inch.

14 Claims, 2 Drawing Sheets

GOLF BALL DIMPLE PATTERN

BACKGROUND OF THE INVENTION

This invention relates generally to golf balls and, in particular, to a geodesic pattern for arranging dimples in an outer spherical surface of a golf ball.

Dimples provide golf balls with important aerodynamic characteristics. For example, dimples create a blanket of air turbulence around a golf ball which reduces drag and thereby increases distance. Dimples also enhance lift as a golf ball spins in a backward direction after being struck by a golf club. When a golf ball is backspinning, the dimples improve air flow above the golf ball thereby resulting in increased air pressure below the golf ball which enhances lift.

It is known that lift and drag can be altered by arranging the dimples in different geodesic patterns such as icosahedrons, octahedrons and dodecahedrons. If lift is increased, a golf ball has a higher trajectory. If drag is reduced, a golf ball travels farther. A proper combination of lift and drag gives satisfactory performance.

Presently, two types of golf balls are most common. Three-piece golf balls have a small core around which windings are wrapped, and a cover in which dimples are formed. Two-piece golf balls have a large core with no windings, and a cover with dimples formed therein. A further aerodynamic characteristic of a golf ball is spin rate which is determined by cover hardness relative to core hardness. Generally, three-piece golf balls have a higher spin rate than two-piece golf balls. Therefore, a particular dimple pattern may result in satisfactory performance on a three-piece golf ball but unsatisfactory performance on a two-piece golf ball.

Geodesic dimple patterns for golf balls have many variations. One conventional dimple pattern is the icosahedron wherein dimples are arranged in twenty triangular regions. A perfect icosahedral dimple pattern is disclosed in British Specification No. 377,354 to Pugh. Since most commercially available golf balls have a cover constructed with a straight seam or parting line lying on an equator of the golf ball, a problem exists in that the icosahedral pattern disclosed by Pugh is interrupted at the equator. The straight seam or parting line results from a conventional molding process used in making golf balls. U.S. Pat. No. 4,653,758 to Karsten Solheim solves this problem by disclosing a method of making a golf ball wherein the cover has a seam that passes back and forth across the equator of the golf ball and thus does not interrupt the Pugh dimple pattern.

A golf ball should also have what is referred to as "spherical symmetry" by the United States Golf Association (USGA). Spherical or aerodynamic symmetry is determined by launching a golf ball so that it spins about one axis and then launching the same golf ball so that it spins about another axis. Any differences in length of flight (i.e. carry) and time of flight are noted. In order to conform to the USGA Rules of Golf, these differences must not be more than three yards for carry or greater than 0.20 seconds for flight time. Changing the dimple pattern on a nonconforming golf ball may make it aerodynamically symmetrical.

A need exists for an improved geodesic dimple pattern for use primarily on, but not limited to, two-piece golf balls having a cover constructed in accordance with the aforementioned Solheim patent.

SUMMARY OF THE INVENTION

An object of the present invention is to provide a geodesic dimple pattern for golf balls which results in improved aerodynamic characteristics, especially on two-piece golf balls.

Another object of the present invention is to provide a geodesic dimple pattern for golf balls which reduces drag and enhances lift.

A further object of the present invention is to provide a geodesic dimple pattern for golf balls that results in a golf ball being aerodynamically symmetrical.

The present invention provides a golf ball having an outer spherical surface with dimples formed therein and arranged in a geodesic pattern defined by a plurality of immaginary grid lines which divide the outer spherical surface into an icosahedron having twenty triangular regions. Each triangular region is defined by three of the grid lines which form a spherical equilateral triangle having three sides of equal length and three medians of equal length. The dimples are arranged so that each side of the triangle radially intersects at least seven dimples and each median of the triangle radially intersects at least six dimples.

In the preferred embodiment, the dimples radially intersected by each side of the triangle have a first diameter and at least two of the dimples radially intersected by each median of the triangle have a second diameter. The first diameter is smaller than the second diameter, and the dimples with the second diameter are arranged in a circular array inside the triangle. There are a plurality of undimpled areas inside the triangle, each of the undimpled areas being bounded by three dimples of the first diameter and two dimples of the second diameter. The golf ball has a total of 362 dimples including 242 dimples with the first diameter which is approximately 0.140 inch and 120 dimples with the second diameter which is approximately 0.150 inch.

DESCRIPTION OF THE PREFERRED EMBODIMENT

Figure 1:
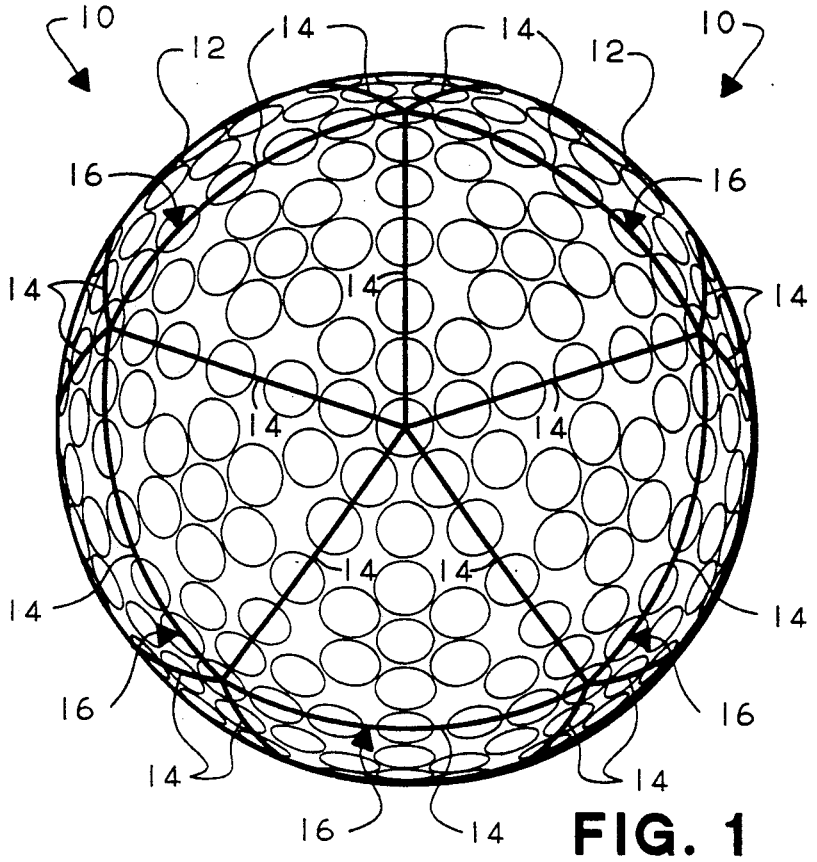
FIG. 1 is a top plan or polar view of a golf ball with a dimple pattern according to the present invention.
Figure 2:
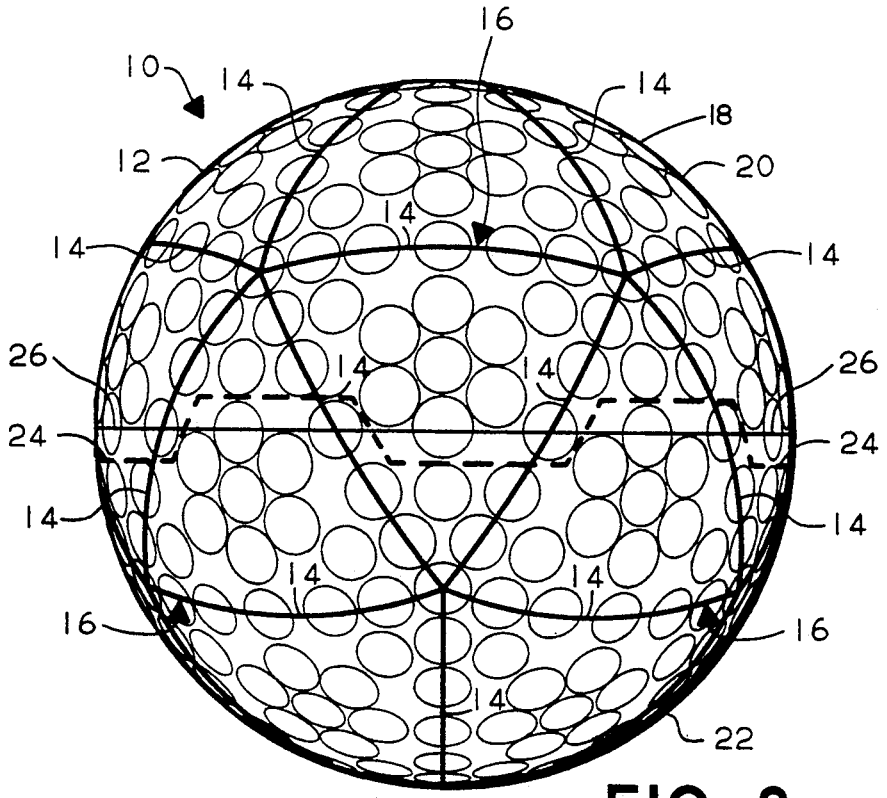
FIG. 2 is a side elevational or equatorial view of the golf ball shown in FIG. 1.

Referring to FIGS. 1 and 2, a golf ball 10 has an outer spherical surface 12 divided by a plurality of imaginary grid lines 14 into a geodesic pattern such as an icosahedron having twenty identical triangular regions 16. Ten of the triangular regions 16 are located in polar sections of the outer spherical surface 12 while the other ten triangular regions 16 are located in equatorial sections of the outer spherical surface 12.

Figure 3:
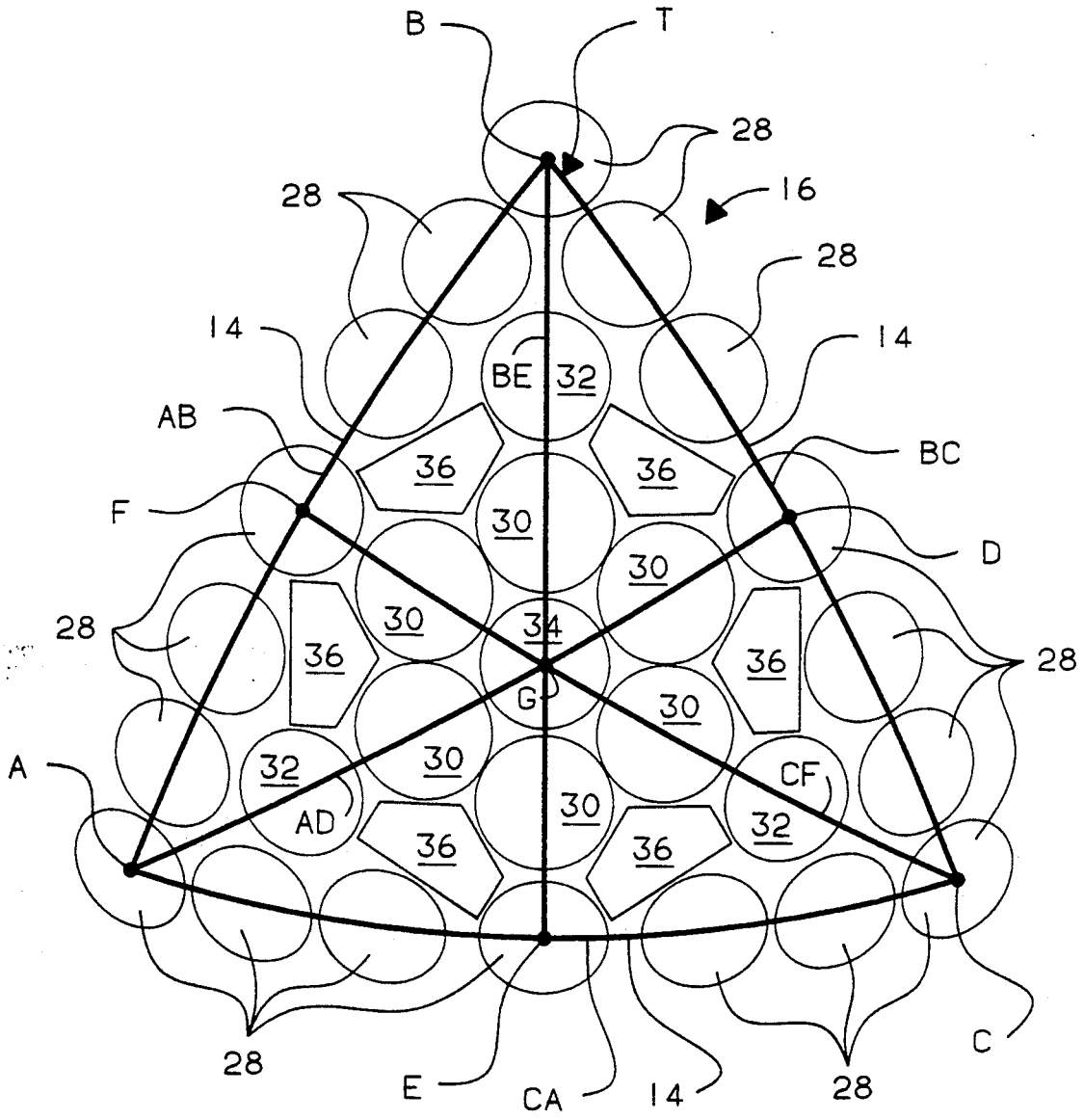
FIG. 3 is a schematic view of one triangular region of the dimple pattern shown in FIGS. 1 and 2.

As seen in FIG. 3, each triangular region 16 is defined by three of the grid lines 14 which form a spherical equilateral triangle T with three apex points A, B, C and three sides AB, BC, CA of equal length. Each triangle T also has three medians of equal length designated AD, BE, CF in FIG. 3 extending between the three apex points A, B, C and midpoints D, F, E of the three sides AB, BC, CA. The three medians AD, BE and CF intersect at a central point G.

The golf ball 10 includes a core (not shown) and a cover 18 formed of two hemispherical sections 20 and 22. A seam or parting line 24 exists where the hemispherical sections 20, 22 of the cover 18 are joined together during a conventional molding process. The cover 18 may be compression molded or injection molded. The seam 24 passes back and forth across an equator 26 of the golf ball 10, and is formed in a conventional manner such as disclosed in U.S. Pat. No. 4,653,758 granted Mar. 31, 1987 to Karsten Solheim, incorporated herein by reference.

Dimples 28 are formed in the outer spherical surface 12 and are arranged on the grid lines 14 defining the triangular regions 16 of the icosahedral pattern. Eighteen of the dimples 28 are disposed in each triangular region 16. Dimples 30 are arranged in circular arrays inside the triangular regions 16, and dimples 32 are arranged near vertices of the triangular regions 16. Six of the dimples 30 and three of the dimples 32 are disposed in each triangular region 16. Arranged centrally of the circular arrays of dimples 30 are dimples 34. Each triangular region 16 has only one of the dimples 34.

In each of the triangular regions 16, the dimples 28, 30, 32 and 34 are arranged so that the sides AB, BC, CA of the triangle T each radially intersect at least seven dimples 28, while the medians AD, BE, CF each radially intersect at least six dimples (i.e. two of the dimples 28, two of the dimples 30, one of the dimples 32, and one of the dimples 34). All of the dimples 28, 30, 32 and 34 are radially intersected by either one of the sides AB, BC, CA or one of the medians AD, BE, CF of the triangle T. This dimple arrangement results in improved aerodynamic characteristics for the golf ball 10 by reducing drag and enhancing lift.

In the preferred embodiment of the golf ball 10, the dimples 28, 32 and 34 have a diameter of approximately 0.140 inch, and the dimples 30 have a diameter of approximately 0.150 inch. All of the dimples 28, 30, 32 and 34 have a depth of about 0.0112 inch and a radius of about 0.090 inch. The diameter to depth ratio for the dimples 28, 32 and 34 is 12.5 to 1, whereas the diameter to depth ratio for the dimples 30 is 13.4 to 1. The golf ball 10 has a total of 362 dimples which includes 242 dimples with the 0.140 inch diameter and 120 dimples with the 0.150 inch diameter. In an alternative embodiment of the golf ball 10, the dimples 28, 32 and 34 have a diameter of 0.150 inch, and the dimples 30 have a diameter of 0.140 inch.

Six bald or undimpled areas 36 are located inside each triangular region 14. These undimpled areas 36 are bounded by five dimples which include two of the dimples 28, two of the dimples 30 and one of the dimples 32. The undimpled areas 36 are generally pentagonal in shape. Since 67.7 percent of the outer surface 12 of the golf ball 10 is covered by the dimples 28, 30, 32 and 34, the remaining 32.2 percent of the outer surface 12 is undimpled.

The golf ball 10 may be of either the three-piece type which has a small core around which windings are wrapped or the two-piece type which has a large core and no windings.

It will be understood that the present invention provides an improved dimple pattern for use primarily on, but not limited to, golf balls having a cover constructed according to the above-mentioned Solheim patent.

What is claimed is:

1. A golf ball comprising:

an outer spherical surface with dimples formed therein, said dimples being arranged in a geodesic pattern defined by a plurality of imaginary grid lines which divide said outer spherical surface into an icosahedron having twenty triangular regions;

each of said triangular regions being defined by three of said grid lines which form a spherical equilateral triangle having three sides of equal length and three medians of equal length; and said dimples being arranged so that each of said sides radially intersects at least seven dimples and each of said medians radially intersects at least six dimples.

2. The golf ball of claim 1, wherein the dimples radially intersected by each said side have a first diameter and wherein at least two of the dimples radially intersected by each said median have a second diameter.

3. The golf ball of claim 2, wherein said first diameter is smaller than said second diameter.

4. The golf ball of claim 2, wherein said first diameter is greater than said second diameter.

5. The golf ball of claim 3, wherein the dimples with said second diameter are arranged in a circular array inside said triangle.

6. The golf ball of claim 1, further comprising a plurality of undimpled areas inside the triangle, each of said undimpled areas being bounded by three dimples of said first diameter and two dimples of said second diameter.

7. The golf ball of claim 6, wherein said undimpled areas are generally pentagonal in shape.

8. The golf ball of claim 3, wherein said first diameter is approximately 0.140 inch, and said second diameter is approximately 0.150 inch.

9. The golf ball of claim 1, further comprising a core disposed inside a cover, and wherein said cover is made of two hemispherical sections which are molded together when the golf ball is manufactured.

10. The golf ball of claim 9, wherein said two hemispherical sections of said cover are joined together at a seam which extends substantially along an equator of the golf ball.

11. The golf ball of claim 10, wherein said seam passes back and forth across said equator.

12. The golf ball of claim 3, wherein a total of 362 dimples are arranged in said geodesic pattern.

13. The golf ball of claim 12, wherein 242 dimples have said first diameter and 120 dimples have said second diameter.

14. The golf ball of claim 12, wherein approximately 68 percent of said outer spherical surface is covered by the 362 dimples, and wherein approximately 32 percent of said outer spherical surface is undimpled.

* * * * *